United States Patent [19]

Harlow

[11] 4,223,864

[45] Sep. 23, 1980

[54] PLAQUE DISPLAYING DEVICES

[76] Inventor: John M. Harlow, 14 Chestnut Way, Derby DE6 6FQ, England

[21] Appl. No.: 879,600

[22] Filed: Feb. 21, 1978

[51] Int. Cl.[3] ..... A47G 1/16

[52] U.S. Cl. ..... 248/490

[58] Field of Search ..... 248/115, 442, 448, 449, 248/488, 490, 491

[56] References Cited

U.S. PATENT DOCUMENTS

| | | | |
|---|---|---|---|
| 213,264 | 3/1979 | Vizet | 248/490 |
| 449,689 | 4/1891 | Nauts | 248/409 |
| 507,044 | 10/1893 | Schmidt | 248/409 |
| 1,002,759 | 9/1911 | Rindge | 248/488 |
| 2,365,108 | 12/1944 | Richards | 248/490 |
| 2,532,162 | 11/1950 | Goss | 248/488 X |
| 2,679,121 | 5/1954 | Hoofer | 248/488 |
| 2,696,962 | 12/1954 | Goss | 248/488 X |
| 2,905,412 | 9/1959 | Kipp | 248/490 |
| 3,788,589 | 1/1974 | Schulze | 248/488 |

*Primary Examiner*—William H. Schultz

*Attorney, Agent, or Firm*—Larson, Taylor and Hinds

[57] ABSTRACT

The invention relates to devices for displaying a plaque, such as a decorative plate, the devices comprising two members which are interengageable in a number of positions to enable various sizes of plaque to be displayed.

4 Claims, 12 Drawing Figures

PLAQUE DISPLAYING DEVICES

BACKGROUND OF THE INVENTION

The invention is concerned with improvements in or relating to plaque displaying devices.

It is frequently required to display on a vertical surface items such as plaques, which term is herein used to include plates or other decorative panels, without directly attaching thereto screws, hooks, pins or other fastenings which would damage the item to be displayed. Yet the plaque must be securely held, especially when it takes the form, for example, of a porcelain plate. Hitherto it has been the customary practice to use a number of clips to engage the marginal portions of the plate and to link these clips under slight tension by means of springs behind the plaque. The assembly may be placed on a wall hook.

It will be appreciated that difficulty will often be encountered in selecting springs of the correct length to hold a fragile plate firmly yet not put too much strain upon it by using too short, and therefore too tightly pulled, a spring.

It is an object of the invention to dispense with such springs and to minimise the requirement for a wide selection of devices of differing sizes for use with variously sized plaques, plates or panels.

BRIEF SUMMARY OF THE INVENTION

The invention therefore provides a plaque displaying device comprising a first member and a second member, means for interengaging said first and second members one with the other, the first member having means to engage edge or marginal portions of a plaque and an elongate portion extending from the plaque-engaging means and provided with longitudinal receiving means, and the second member also having means to engage edge or marginal portions of the plaque and an elongate portion extending from the plaque-engaging means, said elongate portion of the second member being at least partially receivable in said receiving means of the first member in any of a plurality of positions so as to permit variation of the distance between the plaque-engaging means of the first member and of the second member according to the size of the plaque.

In an example according to the invention, the second member is provided with a series of teeth engageable with a toothed projection on the elongate portion of the first member. The toothed projection may be hingedly mounted so as to be disengageable from the teeth when the plaque is to be released.

BRIEF DESCRIPTION OF THE DRAWINGS

There will now be described two plaque displaying devices according to the invention. It will be understood that the description, which is to be read with reference to the accompanying drawings, is given by way of example only and not by way of limitation.

In the drawings.

DETAILED DESCRIPTION OF THE DRAWINGS

Figure 1:
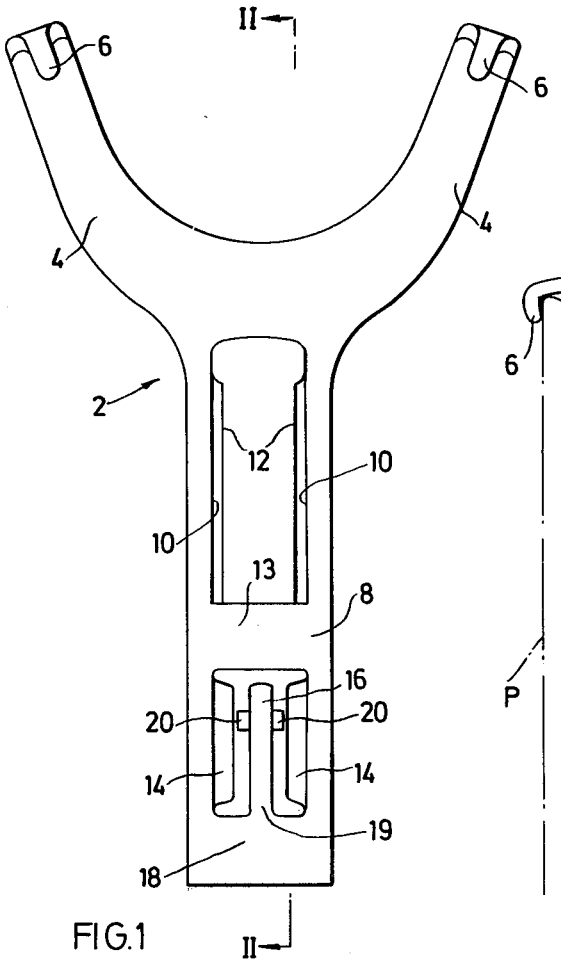
FIG. 1 shows a first member of a first plaque displaying device.
Figure 2:
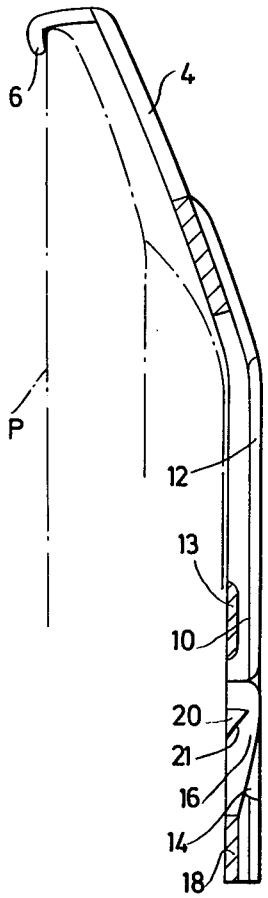
FIG. 2 shows a section taken on line II—II of FIG. 1.
Figure 3:
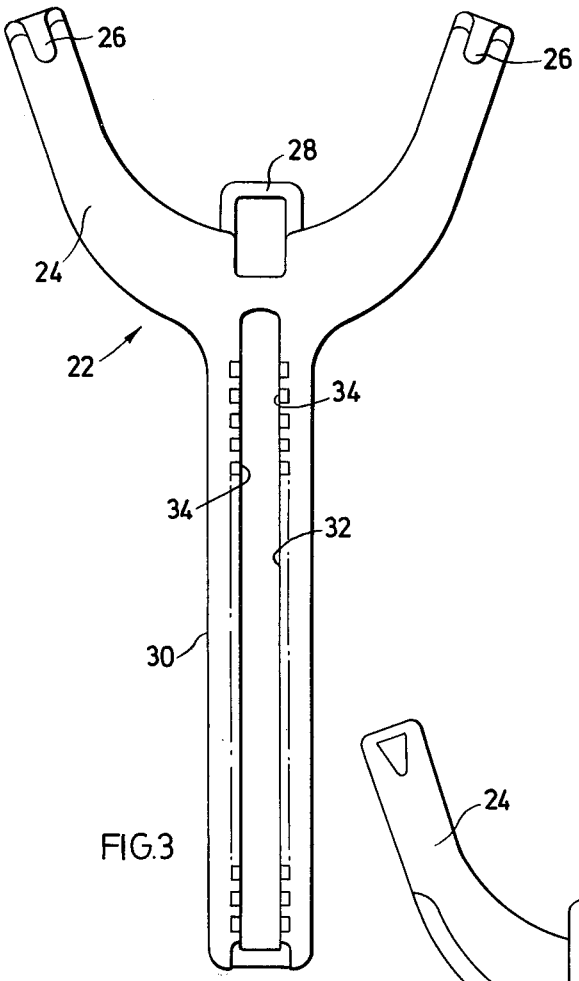
FIG. 3 shows a second member of the device.
Figure 4:
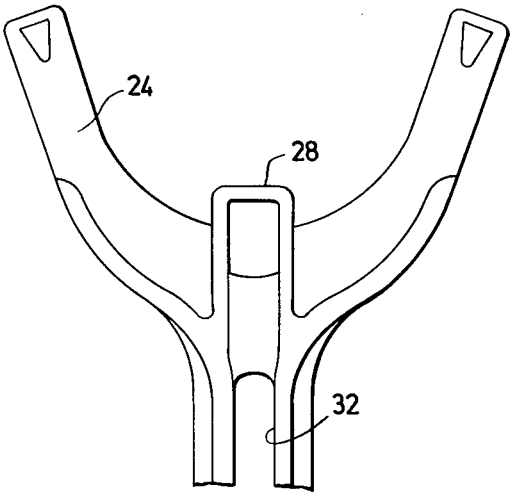
FIG. 4 shows a fragmentary view of the rear of the second member shown in FIG. 3.

FIG. 1 shows a first member 2 of a plaque-displaying device moulded from plastics material. The member 2 is generally Y-shaped in the present example, each arm 4 thereof being provided with an integrally moulded hook 6 capable of engaging edge portions of a plate P. An elongate portion 8, corresponding to the stem of the Y-shape is provided with two grooves 10, formed between guide flanges 12, 14, and portions of the first member spanned by a bridge piece 13. A projection 16 is mounted on a bridge for slight hinging movement at 19 permitted by the resilience of the plastics material. Two teeth 20 are provided on the projection 16, one on each side thereof.

The second member 22 is also generally Y-shaped, and has hooks 26 on each arm 24. However, a loop 28 is formed at the junction of the arms through which a hook will pass in use. An elongate member 30 comprises a central slot 32, the edges of which are provided with two series of square teeth 34.

Figure 5:
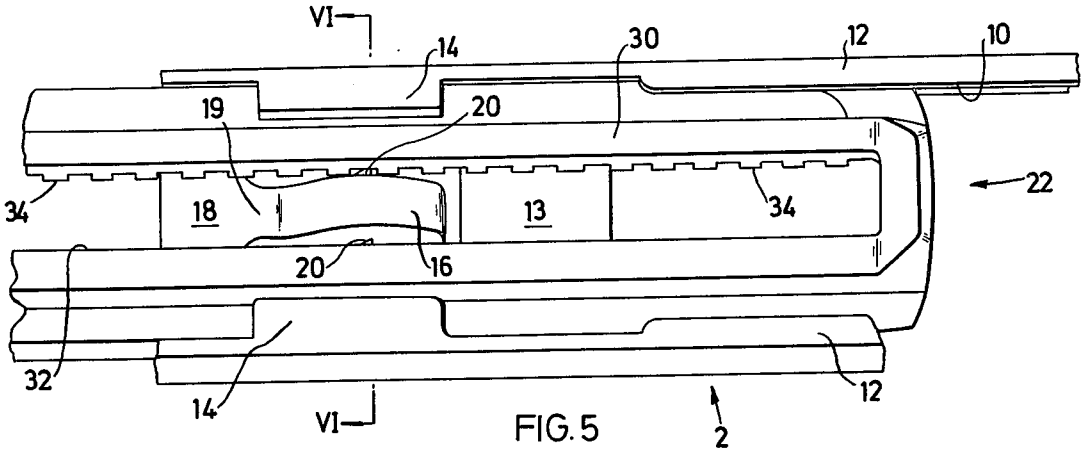
FIG. 5 shows a partial view of the two members shown in FIGS. 1 to 4 in an interengaged condition, to an enlarged scale viewed from the rear relative to the views shown in FIGS. 1 and 3.
Figure 6:
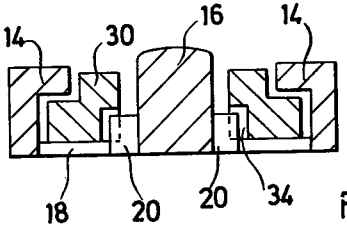
FIG. 6 is a section taken on line VI—VI of FIG. 5.

FIG. 5 illustrates the manner in which the two members interengage. The elongate portion 30 of the second member is partially received in the groove 10 of the first member. When the hooks 6 are at the required relative positions according to the size of the plate P, the teeth 20 on the projection 16 are allowed to remain in engagement with appropriate ones of the teeth 34. It will be noted that the teeth 20 are triangular in shape having a sloping side 21 which permits the portion 30 to enter the groove freely, since the teeth 34 cause the projection to be depressed by contact with the sloping side 21. However, the portion 30 is firmly held against accidental withdrawal until thumb or finger pressure on the projection 16 holds the teeth 20 out of engagement with the teeth 34 while the portion 30 is withdrawn, in the manner of a ratchet.

Figure 7:
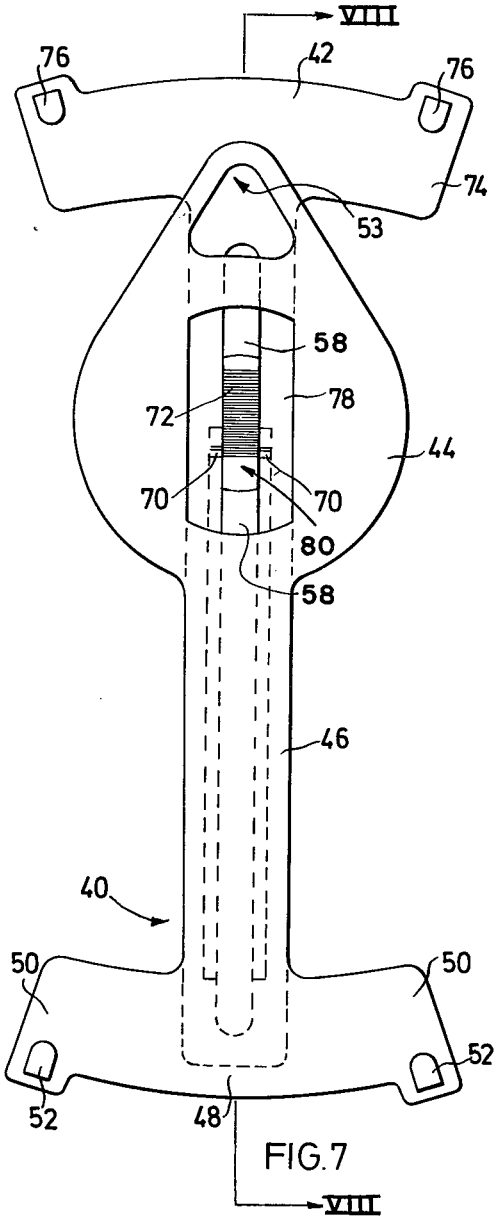
FIG. 7 shows a second plaque displaying device.
Figure 8:
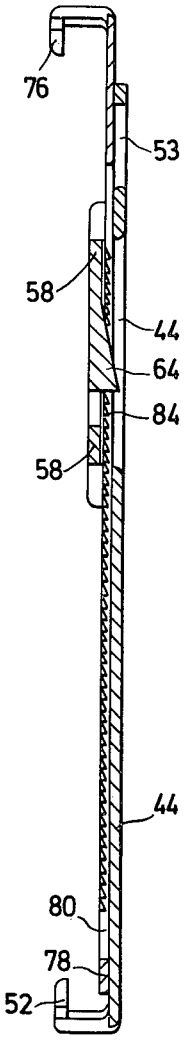
FIG. 8 is a cross sectional view on line VIII—VIII of FIG. 7.

The device shown in FIGS. 7 and 8 comprises two parts a first member 40 and a second member 42.

The first member 40 comprises pear-shaped moulding 44 having an elongate stem 46 extending from a rounded end thereof said stem 46 forming part of an inverted T-shaped process 48.

At an end of each arm 50 of the process there is provided a hook 52 pressed-out of the respective arm 50.

An upper region of the moulding 44 is provided with a triangular perforation 53 which enables the device to be hung from a hook thereby.

Figure 9:
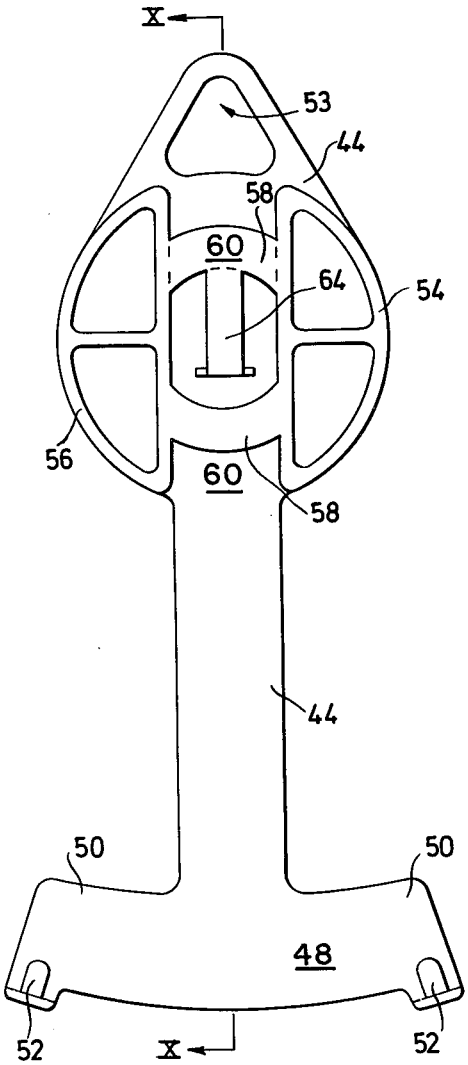
FIG. 9 is a rear view of a first member of the device shown in FIGS. 7 and 8.

Two reinforcing portions (see FIG. 9) 54 and 56 extend from the underside of the moulding 44 normal to the longitudinal axis of the T-shaped process 48. One of the portions, 54, is substantially B-shaped and the other 56 is a complementary mirror image thereof.

The reinforcing portions are connected by two curved bridging members 58 aligned in spaced relationship from and in a parallel plane to a front wall 60 of the moulding 44.

Figure 10:
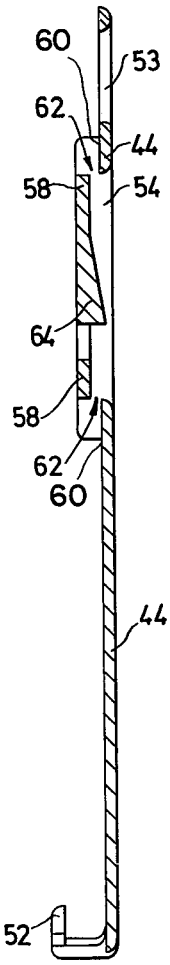
FIG. 10 is a cross sectional view on line X—X of FIG. 9.

The spacings 62 (shown in FIG. 10) between the members 58 and the front wall 60 allows a stem portion of the second member 42 to be slidably received therethrough.

Figure 11:
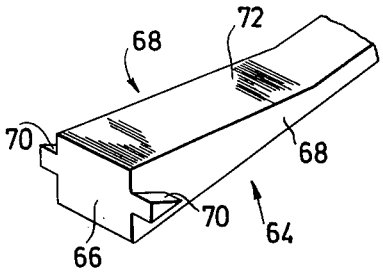
FIG. 11 is a perspective view of a portion of the first member shown in FIGS. 9 and 10.

A thumb-catch 64 is provided on one of the curved members 58 and is shown in detail in FIG. 11. The thumb catch comprises a wedge-shaped body portion 66 on parallel side faces 68 of which are provided respective wedge shaped teeth 70. An upper surface of the body 66 is provided with fine grooves 72 to enable the thumb catch 64 to be moved by an operator's thumb without slipping.

Figure 12:
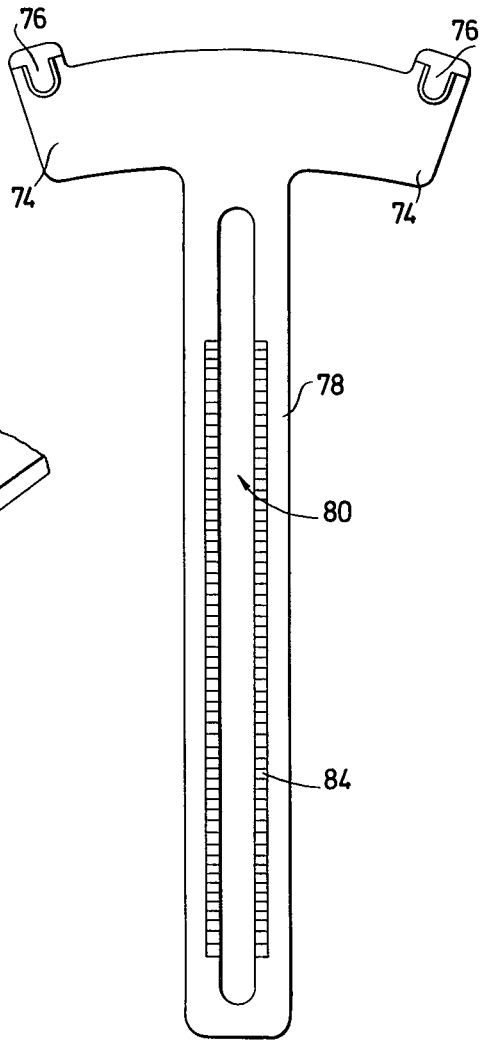
FIG. 12 is a front view of a second member of the device shown in FIGS. 7 and 8.

The second member 43 shown in FIG. 12 is substantially T-shaped and arms 74 of the T are provided at respective ends with a pressed-out hook 76 similar to the hooks 52.

A stem portion 78 of the member 42 is provided with a central longitudinal slot 80, the stem 78 being narrow enough to pass through the spacings 62 and the slot being wide enough to permit the body 66 of the thumb catch 64, but not the teeth 70 to pass therethrough.

Longitudinal margins of the slot, on a side of the member 42 from which the hooks 76 project, are each provided with a row 82 of triangular teeth 84 any one of the pairs of teeth each comprising a corresponding tooth from each row being engageable with the teeth 70 on the thumb catch 64.

In use, the device is adjusted for different plaque sizes by depressing the thumb catch 64 to disengage the teeth 70 from respective teeth of the rows 82, the second member is then moved away from or toward the file member until a plaque is held between hooks 52 and hook 76 and the thumb catch is released allowing the teeth 70 to engage teeth 84 in the rows 82 once more.

The device together with a plaque may be mounted on a hook by inserting the hook through the aperture 53.

The device is preferably made of resilient plastics material but may be made from any suitable material.

Various modifications may be made within the scope of the invention.

I claim:

1. A plaque displaying device comprising:

first and second members, each of said members having an elongate portion;

mounting means provided on one of said members;

engagement means located at one end of the elongate portions of said first and second members for engaging the edge or marginal portions of a plaque;

longitudinal receiving means provided on the elongate portion of said first member which at least partially receives the elongate portion of said second member;

a longitudinal slot located in the elongate portion of one of said members;

a plurality of teeth arranged on each side of said slot, the face of each tooth nearest said engagement means of said member being perpendicular to the longitudinal axis of said member;

a resiliently mounted projection provided on said other member which bridges said slot and which is engageable with any of said teeth, said projection having a right triangular transverse cross-section with the face of said projection nearest said engagement means of said other member being perpendicular to the longitudinal axis of said other member;

such that said engagement means of each member are easily moved toward each other as said first member receives said second member until a plaque is thus held between said engagement means, and the moving apart of said engagement means is prevented by the abutment of the perpendicular faces of said teeth and said projection unless said projection is depressed through said slot lifting said projection clear of said teeth.

2. A plaque displaying device as claimed in claim 1 in which the projection is formed integrally with said other member and both members are manufactured from a plastics material.

3. A plaque displaying device as claimed in claim 1, in which said teeth have a square profile.

4. A plaque displaying device as claimed in claim 1, in which said teeth have a saw-tooth profile.

* * * * *